United States Patent [19]

Young et al.

[11] Patent Number: 4,822,467

[45] Date of Patent: Apr. 18, 1989

[54] DISK PLATING SYSTEM

[75] Inventors: David Young, Mesa; Richard Lamoure, Pheonix; William Bratt, Tempe, all of Ariz.; Vincent Ruscello, Sidney, Ohio; John E. Wilson, Colorado Spring, Colo.

[73] Assignee: Digital Equipment Corporation, Maynard, Mass.

[21] Appl. No.: 113,872

[22] Filed: Oct. 27, 1987

[51] Int. Cl.[4] ..... C25D 17/00

[52] U.S. Cl. ..... 204/212

[58] Field of Search ..... 204/212, 218

[56] References Cited

U.S. PATENT DOCUMENTS 2,776,256 1/1957 Eulner ..... 204/217

4,415,423 11/1983 Brooks ..... 204/212

*Primary Examiner*—T. M. Tufariello

*Attorney, Agent, or Firm*—Nutter, McClennen & Fish

[57] ABSTRACT

The invention is an electroplating apparatus which partially submerges disks in the electrolytic solution, and provides electrical contact to the portions of the disk protruding above the solution. The disks are rotated during plating such that successive portions of the disk emerge from the solution, contact the electrical contact and then re-enter the solution. The disks are inserted into individual disk holders consisting of non-conductive shielding rings attached to a common bracket. The shielding rings are hinged such that the rings may be opened to insert the disks. When the disks are enclosed in the rings, they are supported by small non-conductive support wheels rotatably mounted in the rings. The rings remain stationary as the disks are rotated. To promote even plating, selectively-coated anode sheets are interleaved with the disk holding rings such that each holder has an anode sheet on either side.

36 Claims, 5 Drawing Sheets

DISK PLATING SYSTEM

FIELD OF INVENTION

This invention relates to the field of magnetic disk plating and more particularly to devices for use in electroplating the disks.

BACKGROUND OF INVENTION

Magnetic disks for storage of data signals in computer systems are widely used throughout the computer industry. The storage disks, typically made of aluminum substrates, are coated with a thin layer of material which is capable of storing data in the form of magnetic flux. One method of coating the storage disks with the magnetic material is to electroplate them.

The thin layer of magnetic material must be evenly distributed over the surface of the storage disk. Thus there must be uniform current distribution over the surface of the disk during electroplating. One arrangement used in electroplating the storage disks makes use of an electrically conductive carrier plate with a disk-sized cavity in the center. The storage disk substrate is inserted into the carrier plate cavity and a smaller conductive plate is inserted into the central hub aperture of the disk. The result is a composite plate which is electrically continuous.

The composite plate is inserted into a plating tank containing sufficient electrolytic solution to envelop the plate. An electrical current is then applied to the composite plate to electroplate the storage disk. The plating tank, which is only slightly larger than the composite plate, inhibits stray currents in the electrolytic solution, thus promoting even plating, as does the large, continuous surface provided by the carrier plate and the central conductive plate. After the storage disk is coated, the composite plate is removed from the plating tank and rinsed to remove the plating chemicals (commonly referred to as "chemical drag-out") that have not drained therefrom, and the magnetic disk is removed from the carrier plate. The rinse water is thereafter treated as chemical waste.

The disadvantages of this electroplating technique are: (i) the excessive disk handling required to insert the storage disks in the carrier plate cavity, sometimes resulting in physical damage to the disks; (ii) the large quantities of chemical drag-out removed from the plating tank with the composite plate, resulting in a large amount of chemical waste to be treated; (iii) the electroplating of the entire composite plate, requiring frequent replacement of the carrier plate; and (iv) the inefficiency of electroplating only one disk per plating tank at any time given.

SUMMARY OF INVENTION

The invention is an electroplating apparatus which partially submerges disks vertically in the electrolytic solution, and provides electrical contact to the portions of the disks protruding above the solution. The disks are rotated during plating so that all portions are exposed to the plating current in the solution. Electrically contacting portions of the disks out of the electrolytic solution eliminates the need for conductive disk holders and thus eliminates the plating of the disk holders. Moreover, it also prevents the build-up of plating material at the point of contact. Rotating the disks during plating results in even plating in the circumferential direction and thus eliminates the need for an electrical contact that simultaneously contacts all points on the rim, or outer diameter, of the disk.

In a preferred embodiment of the invention, several disks are inserted into individual disk holders consisting of non-conductive shielding rings attached to a common bracket. Each shielding ring is hinged, that is, the ring opens and closes to facilitate the insertion and removal of a disk with minimal disk handling. When a disk in enclosed in a ring, the disk is supported by small non-conductive support wheels rotatably mounted in the ring. The support wheels, which are mounted in the lower portion of the ring, function in a manner analogous to roller-bearings, allowing the disk to rotate inside the ring while the ring remains stationary. An electrically conductive wheel is rotatably mounted in the upper portion of the ring, above the plating solution, to provide electrical contact to the disk. The contact wheel also serves to rotate the disk.

To promote even plating, each disk is interleaved, in the plating tank, between two selectively-coated anode sheets. While the disks are rotated as described above, the anode sheets can be stationary.

When the disk plating is completed, the shielding rings and the disks are removed from the electrolytic solution and rinsed, and the rinse water is treated as chemical waste. The chemical drag-out associated with the apparatus is significantly reduced over other electroplating apparatus because of the much smaller area of the shielding ring as compared with the carrier plate used in prior apparatus. Moreover, the use of a non-wetting material for the non-conductive shielding ring further reduces drag-out. Thus the cost of treating the chemical waste is likewise reduced. The invention will be pointed out with particularity in the appended claims.

BRIEF DESCRIPTION OF THE DRAWINGS

The above and other advantages of the invention may be better understood by referring to the following description taken in conjunction with the accompanying drawings, in which.

DETAILED DESCRIPTION

Figure 1:
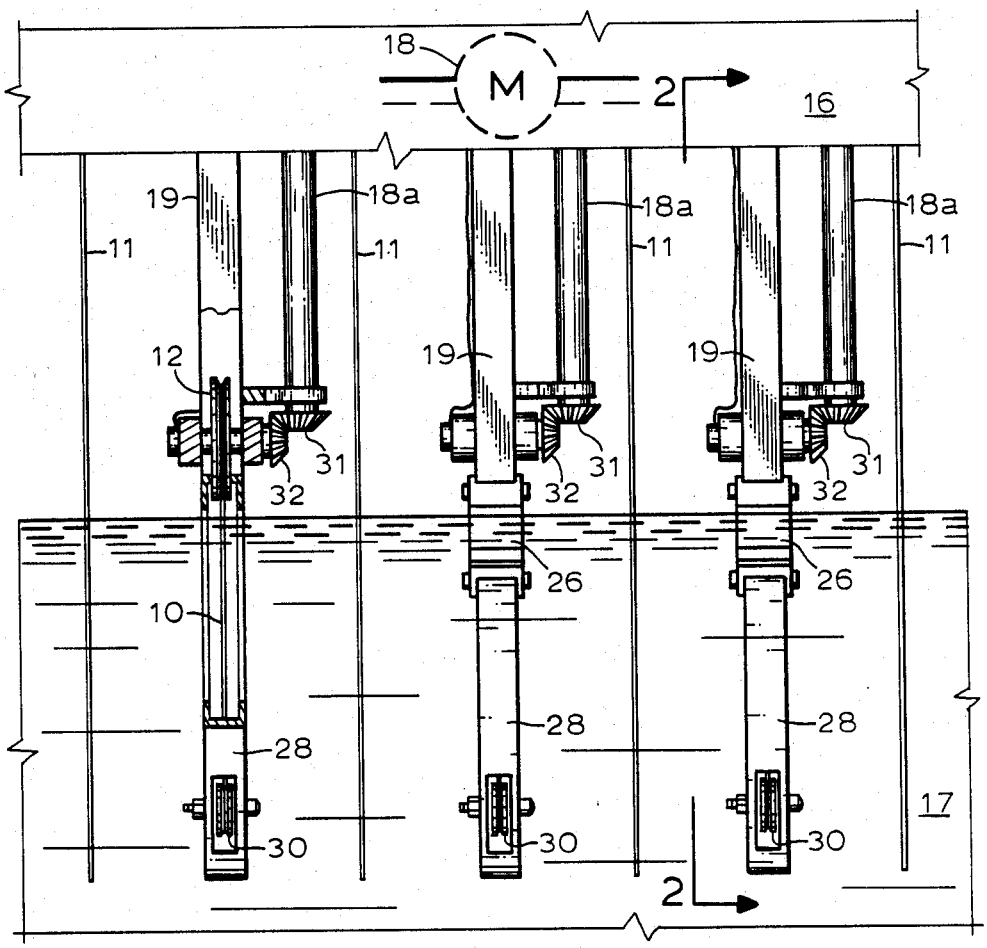
FIG. 1 is a front view of a system including a plurality of shielding rings constructed in accordance with the invention.

With reference to FIG. 1 a multi-disk electroplating unit 7 comprises plurality of shielding rings 28, and a plurality of selectively-coated anode sheets 11, all supported by a common bracket 16. A storage disk 10 is inserted into each of the shielding rings 28, as described below, and the rings 28 and the enclosed disks 10, and the anode sheets 11, are then lowered into a plating tank 17 until the disks are substantially submerged in the electrolytic solution therein, that is, until only the top portions of the disks remain above the solution level.

The disks are electrically contacted on their portions projecting above the solution by electrically conductive contact wheels 12 mounted in the shielding rings 28.

The disks 10 are interleaved with the selectively-coated anode sheets 11, which are connected to eleotrodes (not shown) to complete the circuit required for electroplating. To promote uniform plating, the disks are rotated by the contact wheels 12, which are driven by a common motor 18 through shafts 18*a* and bevel gears 32 and 33. When the disks 10 are fully plated, the rings 28 and the disks 10 are removed from the plating tank 17 and rinsed to remove the plating chemicals, or drag-out. The amount of chemical drag-out associated with the disks is substantially reduced over systems using larger area shielding apparatus.

Figure 3:
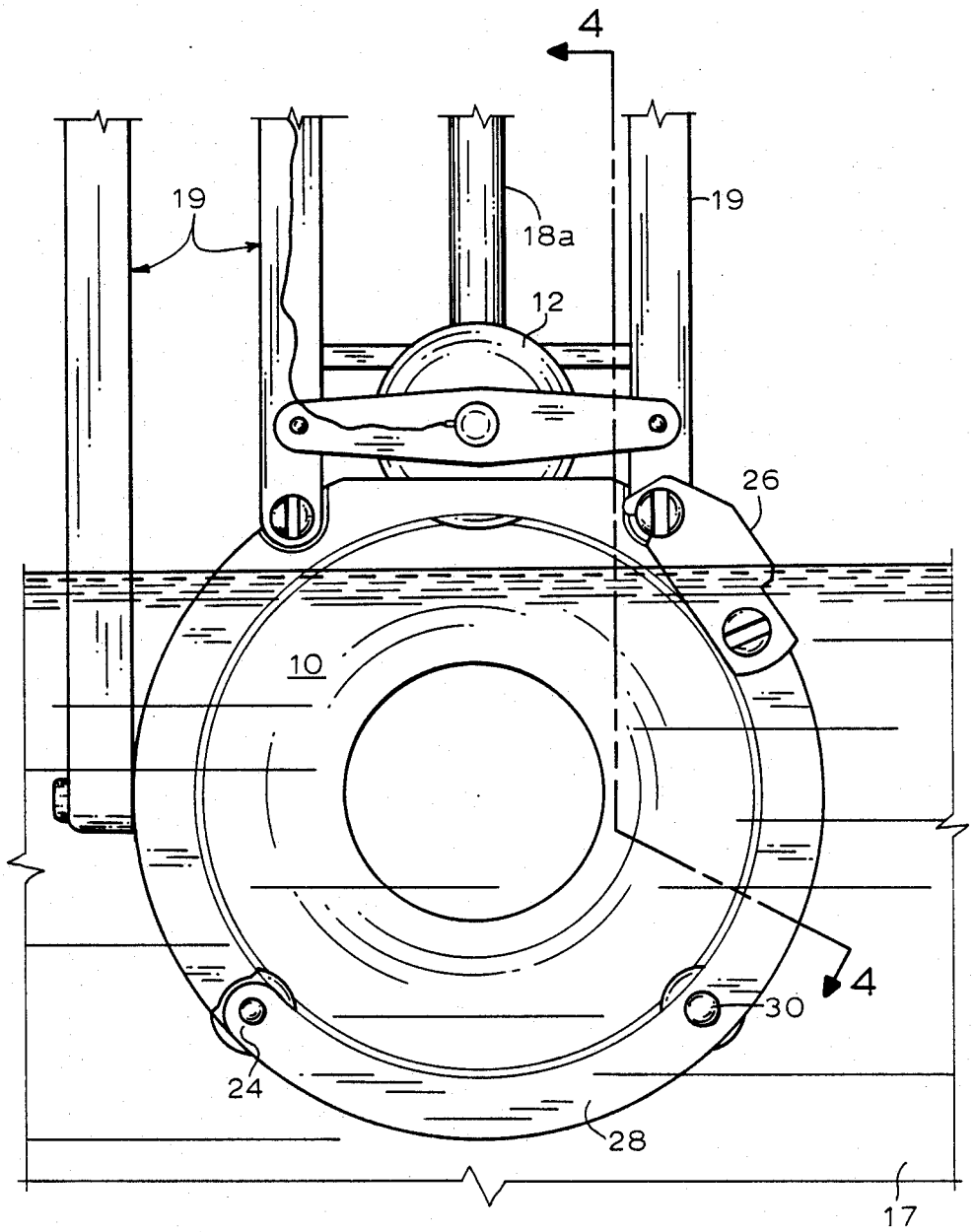
FIG. 3 is a view of a shielding ring depicted in FIG. 1.
Figure 4:
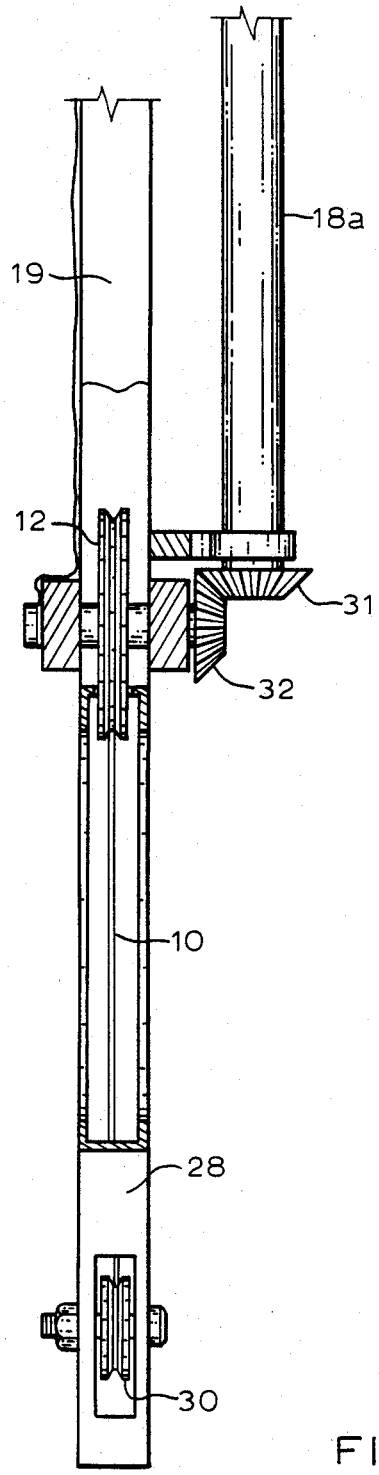
FIG. 4 is a side view of the shielding ring depicted in FIG. 3.
Figure 5:
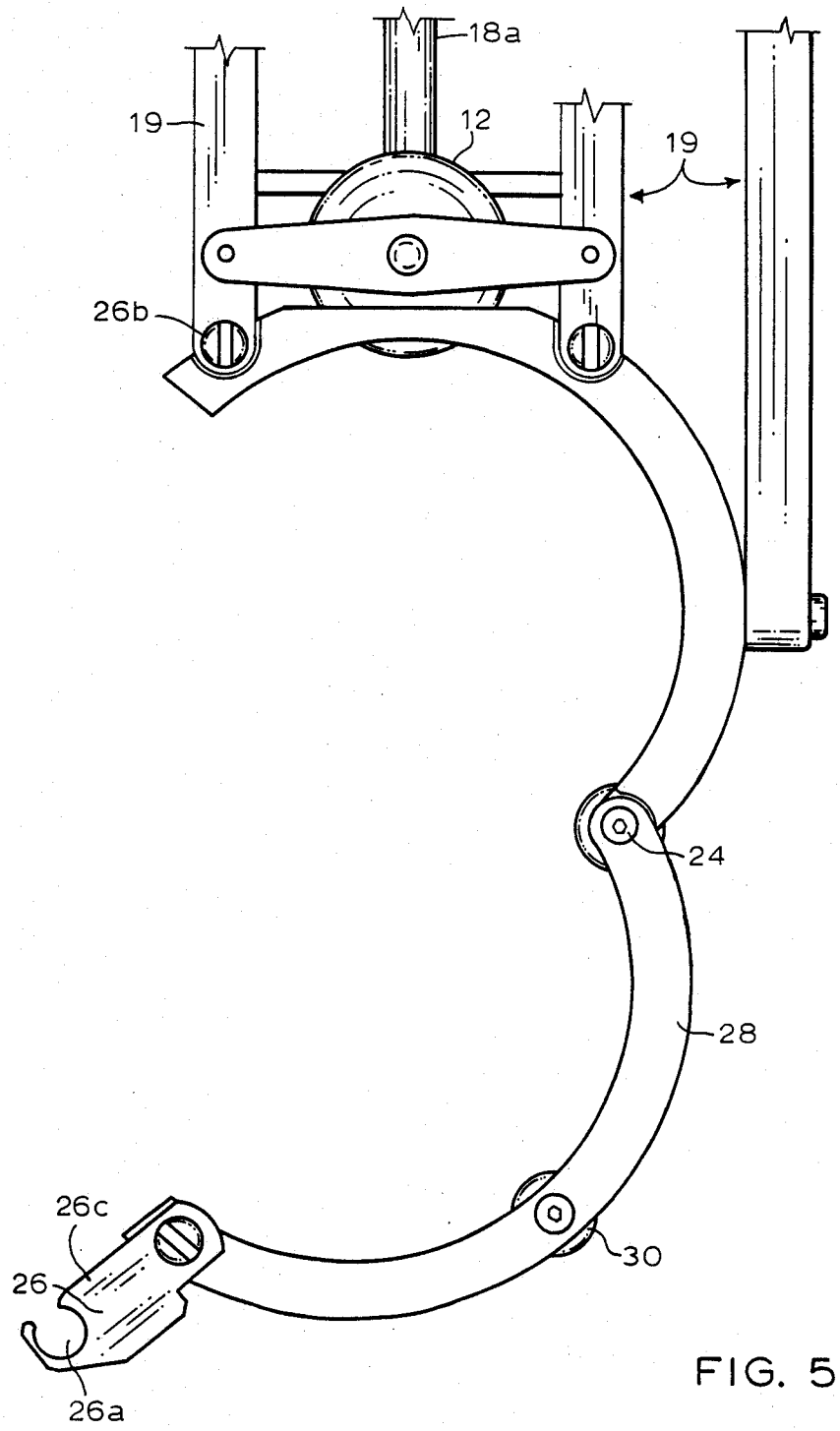
FIG. 5 is a view of the shielding ring in the open position.

FIGS. 3, 4 and 5 depict a shielding ring 28 in various positions. The shielding ring 28 is comprised of an upper section 28*a* and a lower section 28*b* pivotally joined on one side by a hinge 24 and latched on the opposite side by a latch 26. Thus the ring 28 opens and closes around the hinge 24 to facilitate the insertion and removal of a disk 10. The shielding ring 28 can be opened when the latch 26 is in the open position, that is, when a latch arm 26*c* attached to the lower section of the ring 28 is rotated away from a latch pin 26*b* attached to the upper portion of the ring 28, as shown in FIG. 4. The ring 28 is secured in the closed position by locking the latch 26, that is, rotating the latch arm 26*c* until a recess 26*a* at the tip of the arm fits around the pin 26*b*.

The lower section of the ring 28 carries a pair of support wheels 30. The support wheels 30, each rotatably mounted on a bolt 31 in a radial slot 34 in the ring 28, (FIG. 3), support a disk 10. The support wheels 30 permit the disk 10 to rotate while the ring 28 remains stationary.

Still referring to FIG. 3, the upper section of the ring 28 is attached to a bracket 16 (FIG. 1) by suspension arms 19. The upper section of the ring has rotatably mounted therein a contact wheel 12 which contacts a disk 10 disposed in the ring 28. Ordinarily the weight of the contact wheel 12 will be sufficient to maintain its contact with the disk 10. The contact wheel 12 also serves to rotate the disk 10 by means of its frictional engagement with the rim of the disk.

To begin the plating operation, a plurality of disks 10 are loaded into individual shielding rings 28 when the rings are in the open position (FIG. 5). Next, the rings 28 are manually closed, and the latch 26 on each ring 28 is rotated to the locked position. The enclosed disks 10 then rest on the support wheels 30 and are electrically contacted by the contact wheels 12. The support wheels 30 and the contact wheel 12 are grooved along their rims, as shown in FIG. 4. The wheels thus maintain the axial position of the disk 10 enclosed in the ring 28. The wheels also provide a slight radial separation between each disk 10 and its shielding ring 28. The separation, for example, a one-eighth inch or less separation for 5¼ inch diameter disks, minimizes the build-up of plating material at the outer rim of the disks 10 caused by edge effects, that is, by the concentration of plating currents that would otherwise occur at the outer edge of the disks.

Figure 2:
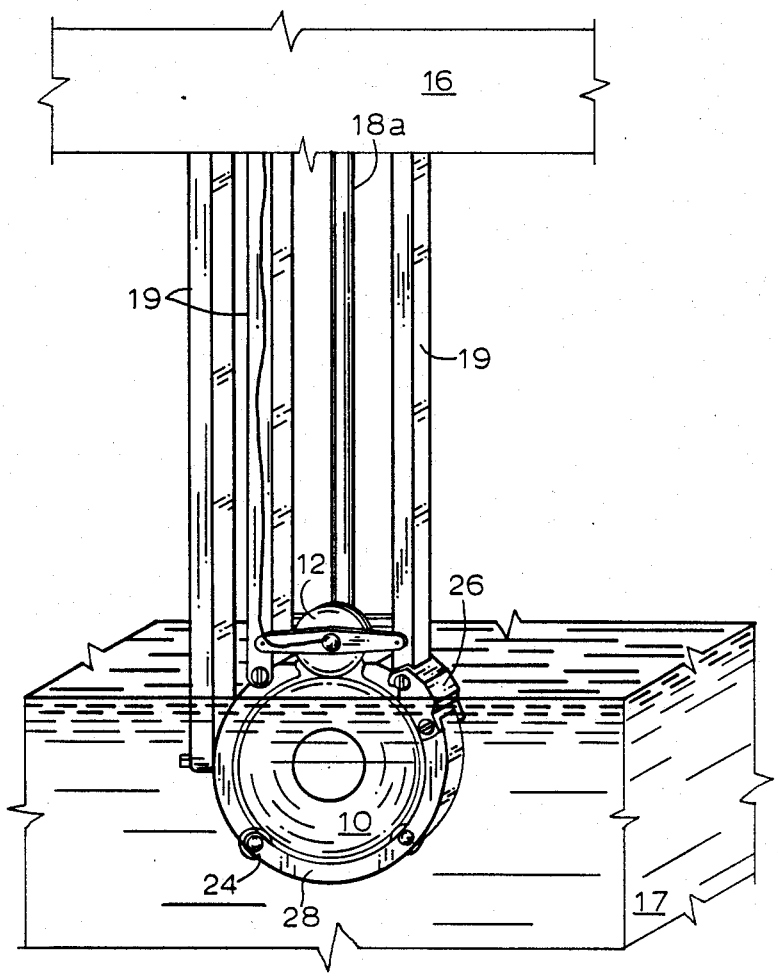
FIG. 2 is a view of the system taken along line 2—2 of FIG. 1.

After the disks have been plated and the disks and their shielding rings 28 rinsed, as described above in connection with FIGS. 1 and 2, the rings 28 are opened by unlocking the latches 26, and the disks are unloaded from the shielding rings 28. The rings 28, which are made of a suitable non-conductive material and not therefore subject to electroplating action in the plating tank 17, for example, a plastic, may then be re-loaded with another set of unplated disks and the plating operation repeated.

The disk plating system is an efficient system for electroplating disks. The system is capable of simultaneously plating several disks in the same plating tank. The disks are rotated and electrically contacted on portions which are out of the plating solution, thus promoting even plating. The chemical drag-out associated with the plating system is also significantly reduced over other electroplating systems, due to the use of the shielding rings. Further advantages of using the shielding rings are that they open and close allowing disks to be loaded and unloaded with minimal handling, thus reducing damage to the disks, and that they can be used for plating repeatedly, without replacement or treatment.

I claim:

1. An apparatus for use in electroplating storage disks, comprising:

means for supporting a disk in a plating solution, whereby the disk is partially submerged in the plating solution;

means for electrically contacting the disk at a point out of the plating solution;

means for rotating the electrically contacted disk in the plating solution so that successive portions of the disk emerge from the solution, contact the contacting means and then re-enter the solution.

2. The apparatus of claim 1 wherein said supporting means contacts the disk on the rim of the disk.

3. The apparatus of claim 2 wherein said supporting means supports the disk so that the successive portions of the rim of the disk emerge from the plating solution and then re-enter the solution.

4. The apparatus of claim 3 wherein said supporting means comprises a non-conductive shielding ring having a diameter slightly larger than the rim of the disk, said shielding ring having a plurality of rotating wheels for supporting the disk for rotation on the wheels.

5. The apparatus of claim 1, wherein said contacting means is an electrically conductive wheel that rotates in contact with the disk.

6. The apparatus of claim 1, wherein said contacting means contacts the disk on the rim of the disk.

7. The apparatus of claim 4, wherein said shielding ring is hinged to open and close for inserting the disk in said ring and removing the disk from said ring.

8. The apparatus of claim 4, wherein said shielding ring has mounted therein said contacting conductive means, comprising an electrically conductive wheel that rotates in contact with the disk.

9. The apparatus of claim 8, wherein said shielding ring has mounted therein said rotating means, comprising a motor driven wheel that rotates the disk by frictional contact with the disk.

10. An apparatus for use in electroplating storage disks, comprising:

means for supporting a disk in a plating solution, whereby the disk is partially submerged in the plating solution; and means for rotating the disk and electrically contacting the disk at a point out of the plating solution so that successive portions of the disk emerge from the solution, contact the electrical contact and then re-enter the solution.

11. The apparatus of claim 10 wherein said supporting means contacts the disk on the rim of the disk.

12. The appartaus of claim 2 wherein said supporting means supports the disk so that successive portions of the rim of the disk emerge from the solution and then re-enter the solution.

13. The apparatus of claim 12 wherein said supporting means comprises a non-conductive shielding ring having a diameter slightly larger than the rim of the disk, said shielding ring having a plurality of rotating wheels supporting the disk for rotation on the wheels.

14. The apparatus of claim 10, wherein said rotating and contacting means is an electrically conductive wheel that rotates in contact with the disk.

15. The apparatus of claim 14, wherein said rotating and contacting means contacts the disk on the rim of the disk.

16. The apparatus of claim 13, wherein said shielding ring is hinged to open and close for inserting the disk in said ring and removing the disk from said ring.

17. The apparatus of claim 13, wherein said shielding ring has mounted therein said rotating and electrically conductive means, comprising an electrically conductive wheel that rotates in contact with the disk.

18. An apparatus for use in electroplating storage disks, comprising:

means for supporting a plurality of disks in a plating solution, whereby each disk is partially submerged in the plating solution;

means for electrically contacting the disks on the portions of the disks which are out of the plating solution; and means for rotating the electrically contacted disks in the plating solution so that successive portions of the disks emerge from the solution contact the contacting means and then re-enter the solution.

19. The apparatus of claim 18 wherein said supporting means contacts the disks on the rims of the disks.

20. The apparatus of claim 18 wherein said supporting means supports the disks so that successive portions of the rims of the disks emerge from the plating solution and then re-enter the solution.

21. The apparatus of claim 19 wherein said supporting means comprises a plurality of non-conductive shielding rings, each having:

a diameter slightly larger than the rim of a disk, and a plurality of rotating wheels for supporting a disk for rotation on the wheels.

22. The apparatus of claim 18, wherein said contacting means is a plurality of electrically conductive wheels that rotate in contact with the disks, wherein one said wheel is mounted in each ring.

23. The apparatus of claim 18, wherein said contacting means contacts the disks on the rims of the disks.

24. The apparatus of claim 21, wherein said shielding rings are hinged to open and close for inserting the disks in said rings and removing the disks from said rings.

25. The apparatus of claim 21, wherein said shielding rings have mounted therein said contacting conductive means, comprising electrically conductive wheels that rotate in contact with the disks.

26. The apparatus of claim 25, wherein said shielding rings have mounted therein said rotating means, comprising motor driven wheels that rotate the disks by frictional contact with the disks.

27. The apparatus of claim 21, said apparatus further comprising selectively-coated anode sheets interleaved with said shielding rings.

28. An apparatus for use in electroplating storage disks, comprising:

means for supporting a plurality of disks in a plating solution, whereby the disks are partially submerged in the plating solution; and means for rotating the disks and electrically contacting the disks on the portions of the disks that are out of the plating solution so that successive portions of the disks emerge from the solution, contact the electrical contacts and then re-enter the solution.

29. The apparatus of claim 28 wherein said supporting means contacts the disks on the rims of the disks.

30. The apparatus of claim 29 wherein said supporting means supports the disks so that successive portions of the rims of the disks emerge from the solution and then re-enter the solution.

31. The apparatus of claim 29 wherein said supporting means comprises a plurality of non-conductive shielding rings, each having:

a diameter slightly larger than the rim of the disk, and a plurality of rotating wheels supporting the disk for rotation on the wheels.

32. The apparatus of claim 27, wherein said rotating and contacting means is a plurality of electrically conductive wheels that rotate in contact with the disks.

33. The apparatus of claim 27, wherein said rotating and contacting means contacts the disks on the rims of the disks.

34. The apparatus of claim 30, wherein said shielding rings are hinged to open and close for inserting the disks in said rings and removing the disks from said rings.

35. The appartus of claim 30, wherein said shielding rings have mounted therein said rotating and electrically conductive means, comprising a plurality of electrically conductive wheels that rotate in contact with the disks.

36. The apparatus of claim 31, said apparatus further comprising selectively-coated anode sheets interleaved with said shielding rings.

* * * * *

UNITED STATES PATENT AND TRADEMARK OFFICE

CERTIFICATE OF CORRECTION

PATENT NO. : 4,822,467

DATED : Apr. 18, 1989

INVENTOR(S) : David Young, et al.

It is certified that error appears in the above-identified patent and that said Letters Patent is hereby corrected as shown below:

On the title page, item [75], "Richard Lamoure" should read --Richard LaMoure--.

Signed and Sealed this

Twenty-second Day of January, 1991

*Attest:*

HARRY F. MANBECK, JR.

*Attesting Officer*

*Commissioner of Patents and Trademarks*